US012258198B2

(12) United States Patent
Donner

(10) Patent No.: US 12,258,198 B2
(45) Date of Patent: Mar. 25, 2025

(54) PLASTIC FILM BAGS AND USE THEREOF

(71) Applicant: Mettler Packaging LLC, Raynham, MA (US)

(72) Inventor: Rene Donner, Morbach (DE)

(73) Assignee: Mettler Packaging LLC, Raynham, MA (US)

( * ) Notice: Subject to any disclaimer, the term of this patent is extended or adjusted under 35 U.S.C. 154(b) by 27 days.

(21) Appl. No.: 17/977,861

(22) Filed: Oct. 31, 2022

(65) Prior Publication Data

US 2023/0137399 A1 May 4, 2023

(30) Foreign Application Priority Data

Nov. 2, 2021 (EP) ..... 21206048

(51) Int. Cl.
*B65D 81/26* (2006.01)
*B65D 75/26* (2006.01)

(52) U.S. Cl.
CPC ..... *B65D 81/264* (2013.01); *B65D 75/26* (2013.01)

(58) Field of Classification Search
CPC ..... B65D 75/26; B65D 81/264
USPC ..... 383/40
See application file for complete search history.

(56) References Cited

U.S. PATENT DOCUMENTS 5,833,058 A 11/1998 Mabry
5,839,572 A * 11/1998 Yeager ..... B65D 31/12 493/194
6,530,471 B1 3/2003 Tsuyuguchi
7,387,205 B1 * 6/2008 Wilson ..... B65D 81/268 206/524.4
2010/0062216 A1 3/2010 Kwak

FOREIGN PATENT DOCUMENTS

WO 98/25835 A1 6/1998

OTHER PUBLICATIONS

European Search Report for Application No. EP 21 206 048.7, dated Apr. 4, 2022, 8 pages.

* cited by examiner

*Primary Examiner* — Peter N Helvey
(74) *Attorney, Agent, or Firm* — Seed IP Law Group LLP

(57) ABSTRACT

A plastic film bag with a bag opening and an opposite bag end includes a plastic film front wall, a plastic film rear wall, a plastic film bag bottom, a plastic film interlayer arranged between the plastic film front wall and the plastic film rear wall, and at least one first layer comprising liquid-absorbent material, wherein the first layer is connected via the front side to the rear side of the plastic film interlayer and extends in the direction of the bottom edge of the plastic film interlayer and ends at a distance from said bottom edge or extends up to the bottom edge or in parts projects beyond the bottom edge in the direction of or up to the plastic film bag bottom. The present disclosure moreover relates to the use of the plastic film bag as a shipping bag, in particular for the transport of liquid samples.

19 Claims, 4 Drawing Sheets

PLASTIC FILM BAGS AND USE THEREOF

BACKGROUND

Technical Field

The present disclosure relates to plastic film bags and to the use thereof as shipping bags, in some cases for transporting liquid samples.

Description of the Related Art

Mail order business is becoming increasingly important worldwide. The ongoing increase in the volume of goods shipped on the one hand and increasing demands for resource-efficient, sustainable transport on the other hand are increasingly requiring the use of space-saving shipping containers. This is often straightforwardly achievable for transport items which present no risk to the environment. In the case of dangerous goods or those capable of harming or at least impairing people or the environment, the logistics company involved is often required for a wide variety of reasons, for example official requirements, to use particularly robust and/or liquid-tight single or even multiple packaging. It is often necessary to use various materials in order to achieve sufficient tightness and/or robustness. This is often diametrically opposed to efficient freight planning and relates, for example, to the transport of liquid samples from the medical sector. There are ever greater volumes of liquid samples such as blood or urine samples, in some cases in pandemic times, not least due to greater awareness among the population. Such samples can be fully automatically mass-screened for relevant pathogens or other components in analysis centers. While it is desirable for such liquid samples not to generate excessive packaging waste, safe transport and delivery must not be jeopardized at any time by making compromises on packaging.

Thus, there is accordingly a need to provide shipping containers which are no longer affected by the drawbacks of the prior art and which in some cases enable safe shipping of liquid samples while simultaneously using as little material as possible.

BRIEF SUMMARY

A first aspect of the present disclosure accordingly provides a plastic film bag with a bag opening and an opposite bag end, comprising a plastic film front wall with a bag opening edge and a first lateral edge and an opposite second lateral edge; a plastic film rear wall with a bag opening edge and with a first lateral edge and an opposite second lateral edge; and a plastic film bag bottom (also denoted "first variant"). The plastic film bag according to the present disclosure of this first variant has, arranged between the plastic film front wall and the plastic film rear wall, a plastic film interlayer with a first lateral edge and an opposite second lateral edge, a bottom-facing edge and an opposite opening-facing edge, and with a rear side facing towards the plastic film rear wall and a front side facing towards the plastic film front wall. Along the opening-facing edge or at a distance from the opening-facing edge, said plastic film interlayer is connected, in some cases welded, to the plastic film rear wall from or at a distance from the first lateral edge in the direction of or up to the opposite second lateral edge. The bottom-facing edge is in this case located at a distance from or on the plastic film bag bottom, and the opening-facing edge is located at or at a distance from the bag opening edge of the plastic film rear wall, in some cases at a distance from the bag opening edge of the plastic film rear wall. The plastic film bag according to the disclosure of this first variant is furthermore equipped with at least one first layer comprising or consisting of a liquid-absorbent material with a front side facing towards the plastic film front wall and a rear side facing towards the plastic film rear wall, wherein the first layer is directly or indirectly connected, in some cases welded, via the front side to the rear side of the plastic film interlayer. In this case, i) the first layer extends in the direction of the bottom-facing edge of the plastic film interlayer and ends at a distance from said bottom-facing edge of the plastic film interlayer or ii) the first layer extends up to the bottom-facing edge of the plastic film interlayer or iii) the first layer projects in parts beyond the bottom-facing edge of the plastic film interlayer in the direction of or up to the plastic film bag bottom. Alternatively or additionally, at least one second layer, comprising or consisting of a liquid-absorbent material, may be provided with a front side facing towards the plastic film front wall and a rear side facing towards the plastic film rear wall, wherein the second layer is directly or indirectly connected, in some cases welded, via the rear side to the plastic film rear wall. In this case, i) the second layer extends in the direction of the bottom-facing edge of the plastic film interlayer and ends at a distance from said bottom-facing edge of the plastic film interlayer or ii) the second layer extends up to the bottom-facing edge of the plastic film interlayer or iii) the second layer projects in parts beyond the bottom-facing edge of the plastic film interlayer in the direction of or up to the plastic film bag bottom.

In this first variant of the plastic film bag according to the present disclosure, the plastic film interlayer is, in an expedient embodiment, welded at or in some cases at a distance from the opening-facing edge to the plastic film rear wall of the first lateral edge up to the opposite second lateral edge, and the bottom-facing edge is located at a distance from the plastic film bag bottom and the opening-facing edge is located at a distance from the bag opening edge of the plastic film rear wall.

If the first layer containing or consisting of the liquid-absorbent material is used in the first variant, said layer in some cases projects in portions beyond the bottom-facing edge of the plastic film interlayer, in some cases in the embodiment in which the plastic film interlayer does not extend up to the plastic film bag bottom. The remaining portion, which in this embodiment does not project beyond the bottom-facing edge of the plastic film interlayer, is usually the larger of the two portions in terms of area.

If the second layer containing or consisting of the liquid-absorbent material is used in the first variant, said layer in some cases projects in portions beyond the bottom-facing edge of the plastic film interlayer, in some cases in the embodiment in which the plastic film interlayer does not extend up to the plastic film bag bottom. The remaining portion, which in this embodiment does not project beyond the bottom-facing edge of the plastic film interlayer, is usually the larger of the two portions in terms of area.

BRIEF DESCRIPTION OF THE DRAWINGS

Further features and advantages of the present disclosure arise from the following description, in which exemplary embodiments of the present disclosure are explained by way of example with reference to schematic drawings, without thereby limiting the present disclosure, in which.

DETAILED DESCRIPTION

Figure 1:
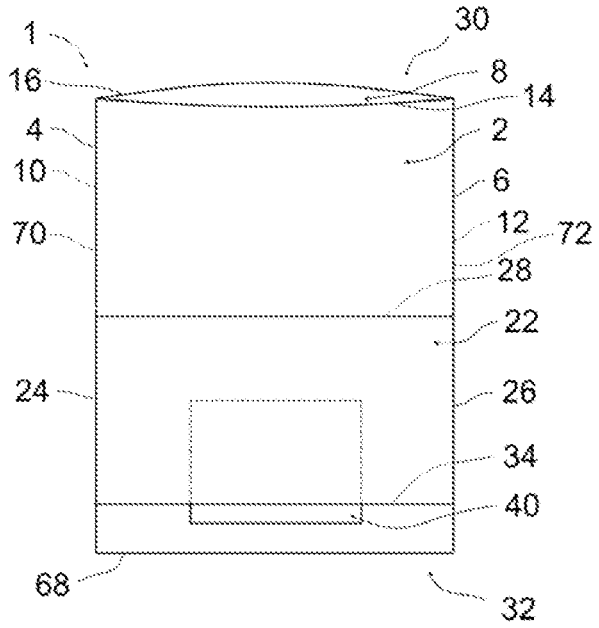
FIG. 1 shows a schematic plan view of a first embodiment of the first variant of the plastic film bag according to the present disclosure.

In one particularly suitable embodiment of the first variant of the plastic film bag according to the present disclosure, the bottom-facing edge of the plastic film interlayer is in some cases not connected to the plastic film front wall and/or, in some cases and, to the plastic film rear wall. Expediently, apart from the connection along the opening-facing edge or at a distance from the opening-facing edge to the plastic film rear wall and the connection of the first lateral edge to the plastic film front wall and the plastic film rear wall in the region of the first lateral boundary and the connection of the second lateral edge to the plastic film front wall and the plastic film rear wall in the region of the second lateral boundary, the plastic film interlayer is not connected to the plastic film front wall and/or, in some cases and, the plastic film rear wall.

According to a second aspect of the present disclosure, a plastic film bag is provided with a bag opening and an opposite bag end, comprising a plastic film front wall with a bag opening edge and a first lateral edge and an opposite second lateral edge; a plastic film rear wall with a bag opening edge and with a first lateral edge and an opposite second lateral edge; and a plastic film bag bottom (also denoted "second variant"). The plastic film bag according to the present disclosure of this second variant has, arranged between the plastic film front wall and the plastic film rear wall, a plastic film interlayer with a first lateral edge and an opposite second lateral edge, a bottom-facing edge and an opposite opening-facing edge, and with a rear side facing towards the plastic film rear wall and a front side facing towards the plastic film front wall. Along the bottom-facing edge or at a distance from the bottom-facing edge, said plastic film interlayer is connected, in some cases welded, to the plastic film rear wall from or at a distance from the first lateral edge in the direction of or up to the opposite second lateral edge. The bottom-facing edge is in this case located at the plastic film bag bottom or in some cases at a distance from the plastic film bag bottom, and the opening-facing edge is located at or in some cases at a distance from the bag opening edge of the plastic film rear wall, in some cases at a distance from the plastic film rear wall. The plastic film bag according to the present disclosure of this second variant is furthermore equipped with at least one first layer comprising or consisting of a liquid-absorbent material with a front side facing towards the plastic film front wall and a rear side facing towards the plastic film rear wall, wherein the first layer is directly or indirectly connected, in some cases welded, via the front side to the rear side of the plastic film interlayer. In this case, i) the first layer extends in the direction of the opening-facing edge of the plastic film interlayer and ends at a distance from said opening-facing edge of the plastic film interlayer or ii) the first layer extends up to the opening-facing edge of the plastic film interlayer or iii) the first layer projects in parts beyond the opening-facing edge of the plastic film interlayer in the direction of or up to the bag opening. Alternatively or additionally, at least one second layer, comprising or consisting of a liquid-absorbent material, may be provided with a front side facing towards the plastic film front wall and a rear side facing towards the plastic film rear wall, wherein the second layer is directly or indirectly connected, in some cases welded, via the rear side to the plastic film rear wall. In this case, i) the second layer either extends in the direction of the opening-facing edge of the plastic film interlayer and ends at a distance from said opening-facing edge of the plastic film interlayer or ii) the second layer extends up to the opening-facing edge of the plastic film interlayer or iii) the second layer projects in parts beyond the opening-facing edge of the plastic film interlayer in the direction of or up to the plastic film bag bottom.

In this second variant of the plastic film bag according to the present disclosure, the plastic film interlayer is, in an expedient embodiment, welded at or in some cases at a distance from the bottom-facing edge to the plastic film rear wall of the first lateral edge up to the opposite second lateral edge, and the opening-facing edge is located at a distance from the bag opening edge of the plastic film rear wall.

If the first layer containing or consisting of the liquid-absorbent material is used in the second variant, said layer in some cases projects in portions beyond the opening-facing edge of the plastic film interlayer, in some cases in the embodiment in which the plastic film interlayer does not extend up to the bag opening edge. The remaining portion, which in this embodiment does not project beyond the opening-facing edge of the plastic film interlayer, is usually the larger of the two portions in terms of area.

If the second layer containing or consisting of the liquid-absorbent material is used in the second variant, said layer in some cases projects in portions beyond the opening-facing edge of the plastic film interlayer, in some cases in the embodiment in which the plastic film interlayer does not extend up to the bag opening edge. The remaining portion, which in this embodiment does not project beyond the opening-facing edge of the plastic film interlayer, is usually the larger of the two portions in terms of area.

In one highly suitable embodiment of the first variant of the plastic film bag according to the present disclosure, the opening-facing edge of the plastic film interlayer is in some cases not connected to the plastic film front wall and/or, in some cases and, to the plastic film rear wall. Expediently, apart from the connection along the bottom-facing edge or at a distance from the bottom-facing edge to the plastic film rear wall and the connection of the first lateral edge to the plastic film front wall and the plastic film rear wall in the region of the first lateral boundary and the connection of the second lateral edge to the plastic film front wall and the plastic film rear wall in the region of the second lateral boundary, the plastic film interlayer is not connected to the plastic film front wall and/or, in some cases and, the plastic film rear wall.

In highly expedient embodiments of the plastic film bags according to the present disclosure, the first lateral edge of the plastic film front wall and the first lateral edge of the plastic film rear wall are connected, in some cases welded, together to form a first lateral boundary. In this case, it may alternatively and in some cases additionally be provided that the second lateral edge of the plastic film front wall and the second lateral edge of the plastic film rear wall are connected, in some cases welded, together to form a second lateral boundary.

In expedient embodiments of the plastic film bags according to the present disclosure, the plastic film bag bottom is located at the transition from the plastic film front wall to the plastic film rear wall and may for example take the form of a fold, pleat or weld seam. The bag bottom in some cases constitutes the transition from the bag front wall to the bag rear wall. The bag front wall and bag rear wall are in this case in one piece.

The liquid-absorbent material of the first and second layers in some cases is a water-absorbent material or a material which is capable of absorbing alcoholic liquids such as methanol or ethanol. The first layer and/or, in some cases and, the second layer of liquid-absorbent material may for example take the form of a non-woven layer. Alternatively, also other textile layers can be used for this purpose, for example in the form of woven, weft-knitted or warp-knitted fabrics. The action as a liquid-absorbent material may in some cases be attributed to capillary effects of the layer material and/or, in some cases and, to the hygroscopic properties of the liquid-absorbent material, in some cases non-woven material. Liquid-absorbent materials which may in some cases be considered are for example fiber materials and sponges. Suitable fiber materials comprise for example thermoplastic fibers such as polyolefin fibers such as polyethylene fibers, polyester fibers such as polyethylene terephthalate fibers, and also polyamide fibers, and furthermore also cellulose-based fibers.

The first layer may be directly or indirectly connected to the rear side of the plastic film interlayer. In the case of a direct connection, the first layer is located directly on the plastic film interlayer and is connected to the latter in some cases by means of adhesive bonding or welding. The second layer may furthermore also be directly or indirectly connected to the plastic film rear wall. In the case of a direct connection, the second layer is located directly on the plastic film rear wall and is connected to the later in some cases by means of adhesive bonding or welding.

In the case of an indirect connection of the first layer to the rear side of the plastic film interlayer, an expedient embodiment has a further plastic film layer connected to the front side of the first layer, via which the first layer is connected to the rear side of the plastic film interlayer. Said further plastic film layer is in some cases made from the same material as the plastic film front wall, plastic film rear wall and plastic film interlayer. In this way, a substantially single-material product can be obtained. To fix the first layer, the further plastic film layer is connected to the plastic film interlayer in some cases by means of adhesive bonding or welding.

In the case of an indirect connection of the second layer to the plastic film rear wall, an expedient embodiment has a further plastic film layer connected to the rear side of the second layer, via which the second layer is connected to the plastic film rear wall. Said further plastic film layer is also in some cases made from the same material as the plastic film front wall, plastic film rear wall and plastic film interlayer. To fix the second layer, the further plastic film layer is connected to the plastic film rear wall in some cases by means of adhesive bonding or welding.

In expedient embodiments of the plastic film bags according to the present disclosure, the connection of the plastic film interlayer to the plastic film rear wall extends from or at a distance from the first lateral boundary in the direction of or up to the second lateral boundary, in some cases from the first lateral boundary up to the second lateral boundary.

Such plastic film bags according to the present disclosure are highly expedient in which the first lateral edge of the plastic film interlayer is connected to the plastic film front wall and the plastic film rear wall in the region of the first lateral boundary. In this case, it may alternatively and in some cases additionally be provided that the second lateral edge of the plastic film interlayer is connected to the plastic film front wall and the plastic film rear wall in the region of the second lateral boundary.

An embodiment which is highly expedient, in some cases for machine production, is also one in which the plastic film front wall, the plastic film rear wall and the plastic film bag bottom are formed in one piece.

Thermoplastic plastics are expediently used for the plastic film front wall, the plastic film rear wall and the plastic film interlayer and optionally the further plastic film layer, wherein polyesters, in some cases polyethylene terephthalate, and polyolefins, in some cases polyethylene, are expedient. Polyethylene is highly expedient.

If thermoplastic plastics are used for the plastic film interlayer, the plastic film rear wall and the first layer and optionally for the further plastic film layer, the first layer can in some cases be connected to the plastic film interlayer or the plastic film rear wall by way of thermoplastic welding.

In highly expedient configurations, the plastic film bags according to the present disclosure may have a, in some cases reclosable, bag closure in the region of the bag opening.

In some cases also to obtain a larger volume, the plastic film bags according to the present disclosure may also be equipped with a first plastic film side wall or a second plastic film side wall, but in some cases with a first and a second plastic film sidewall.

The plastic film bags according to the present disclosure are in some cases also suitable as shipping bags, in some cases for liquid samples. The plastic film bags according to the present disclosure used for this purpose are in some cases those equipped with a, in some cases reclosable, bag closure in the region of the bag opening.

The present disclosure is associated with the surprising finding that goods for shipment in the form of liquid samples can be safely and reliably transported with plastic film bags, wherein these plastic film bags can be cost-effectively mass-produced on a large industrial scale. Even if the liquid samples should suffer damage during transport, it can be reliably ensured that any liquid leaks are absorbed and prevented from escaping from the transport container, and that any further goods being transported in the plastic film bag are not affected.

Figure 5:
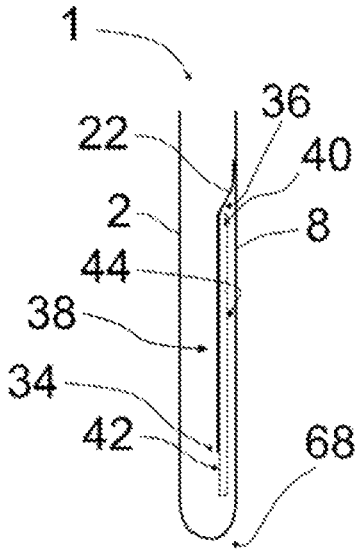
FIG. 5 shows a schematic cross-sectional view of the first embodiment of the first variant of the plastic film bag according to the present disclosure.

FIG. 1 shows a plastic film bag (1) according to the present disclosure according to the first variant with a bag opening (30) and an opposite bag end (32). This plastic film bag is formed from a plastic film front wall (2) with a bag opening edge (14) and a first lateral edge (4) and an opposite second lateral edge (6) and a plastic film rear wall (8) with a bag opening edge (16) and with a first lateral edge (10) and an opposite second lateral edge (12). It has a plastic film bag bottom (68) in the form of a fold. Between the plastic film front wall (2) and the plastic film rear wall (8), a plastic film interlayer (22) is arranged with a first lateral edge (24) and an opposite second lateral edge (26), a bottom-facing edge (34) and an opposite opening-facing edge (28) and with a rear side (36) facing towards the plastic film rear wall (8) and a front side (38) facing towards the plastic film front wall (2). The plastic film interlayer (22) is welded along the opening-facing edge (28) to the plastic film rear wall (8) from the first lateral edge (4, 10) up to the opposite second lateral edge (6, 12). The bottom-facing edge (34) is located at a distance from the plastic film bag bottom (68). The opening-facing edge (28) is correspondingly located at a distance from the bag opening edge (30) of the plastic film rear wall (8). A first layer (40) of a non-woven material is welded with the front side (42) facing towards the plastic film front wall (2) to the rear side (36) of the plastic film interlayer (22). Said non-woven layer (40) projects in portions beyond the bottom-facing edge (34) of the plastic film interlayer (22) in the direction of the plastic film bag bottom (68), wherein the remaining larger portion is located above the bottom-facing edge (34). In the embodiment shown, the bottom-facing edge (34) of the plastic film interlayer (22) is connected neither to the plastic film front wall (2) nor to the plastic film rear wall (8). Instead, there is only one connection along the opening-facing edge (28) to the plastic film rear wall (8) and a connection of the first lateral edge (4, 10) to the plastic film front wall (2) and the plastic film rear wall (8) in the region of the first lateral boundary (70) and a connection of the second lateral edge (6, 12) to the plastic film front wall (2) and the plastic film rear wall (8) in the region of the second lateral boundary (72). Accordingly, in this embodiment, the first lateral edge (4) of the plastic film front wall (2) and the first lateral edge (10) of the plastic film rear wall (8) are welded together to form a first lateral boundary, while the second lateral edge (6) of the plastic film front wall (2) and the second lateral edge (12) of the plastic film rear wall (8) are also welded together to form a second lateral boundary. In the embodiment shown, the plastic film bag according to the present disclosure does not additionally have plastic film side walls. FIG. 5 shows a schematic cross-sectional view of the embodiment according to FIG. 1.

Figure 2:
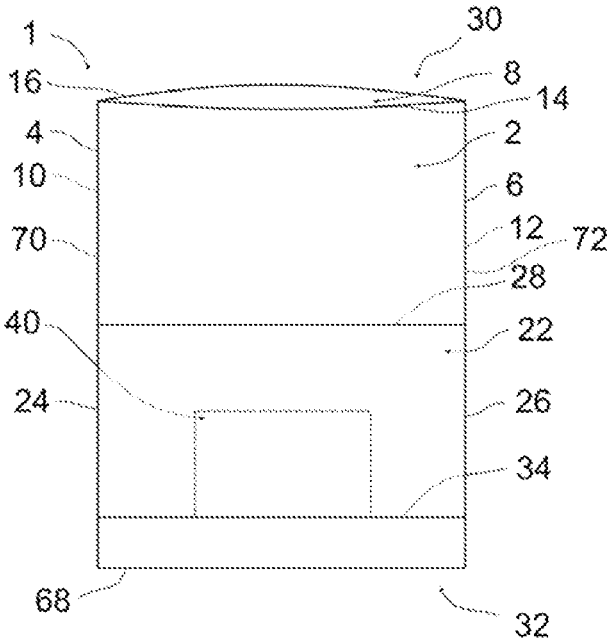
FIG. 2 shows a schematic plan view of a second embodiment of the first variant of the plastic film bag according to the present disclosure.
Figure 6:
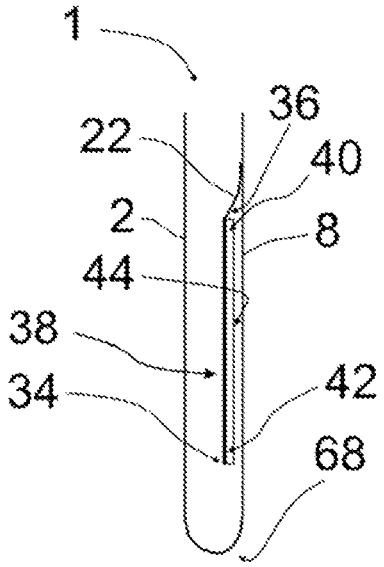
FIG. 6 shows a schematic cross-sectional view of the second embodiment of the first variant of the plastic film bag according to the present disclosure.

The plastic film bag (1) according to FIG. 2 differs from the plastic film bag according to FIG. 1 in that the first layer (40) extends up to, but does not project beyond, the bottom-facing edge (34) of the plastic film interlayer (22). FIG. 6 shows a schematic cross-sectional view of this embodiment.

Figure 3:
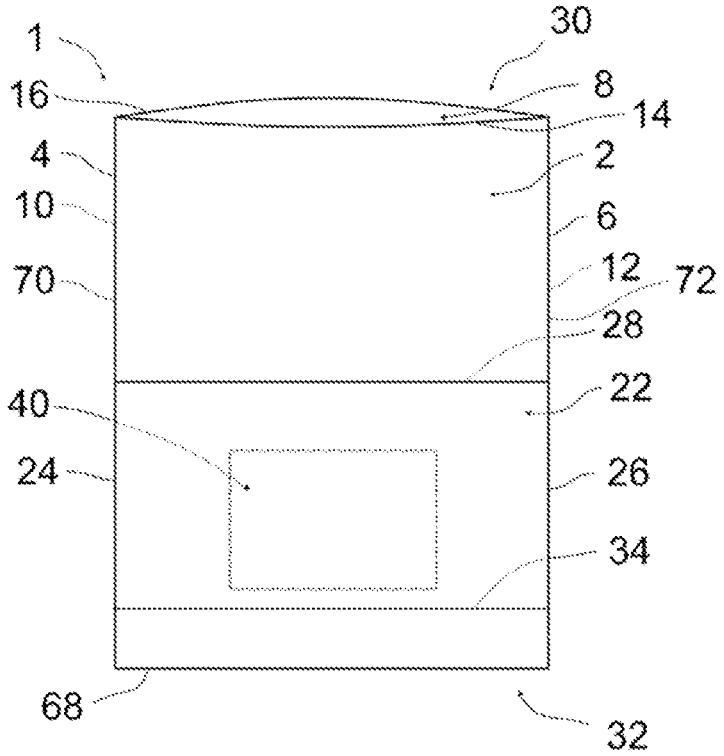
FIG. 3 shows a schematic plan view of a third embodiment of the first variant of the plastic film bag according to the present disclosure.

The plastic film bag (1) according to FIG. 3 differs from the plastic film bag according to FIG. 1 in that the first layer (40) ends at a distance from the bottom-facing edge (34) of the plastic film interlayer (22), i.e., does not extend up to, nor project beyond, the bottom-facing edge (34) of the plastic film interlayer (22).

Figure 4:
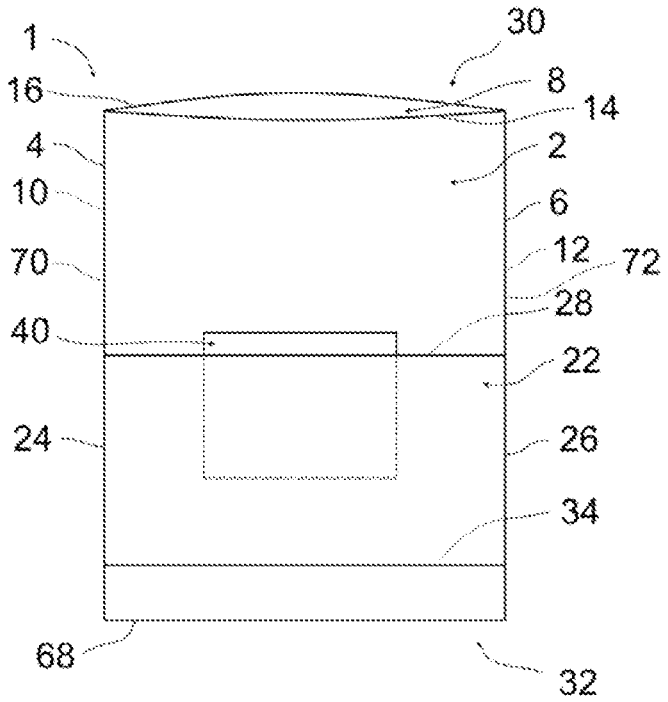
FIG. 4 shows a schematic plan view of a first embodiment of the second variant of the plastic film bag according to the present disclosure.
Figure 7:
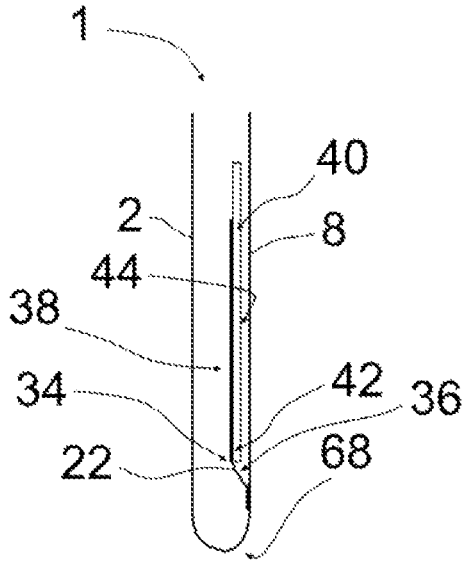
FIG. 7 shows a schematic cross-sectional view of the first embodiment of the second variant of the plastic film bag according to the present disclosure and FIG. 8 shows a schematic cross-sectional view of a third embodiment of the first variant of the plastic film bag according to the present disclosure.

FIG. 4 shows a schematic plan view of an embodiment of the second variant of the plastic film bag according to the present disclosure. In this variant, the plastic film interlayer (22) arranged between the plastic film front wall (2) and the plastic film rear wall (8) is welded along the bottom-facing edge (34) to the plastic film rear wall (8) from the first lateral edge (4, 10) up to the opposite second lateral edge (6, 12). The bottom-facing edge (34) is here located at a distance from the plastic film bag bottom (68) and the opening-facing edge (28) is also at a distance from the bag opening edge (30) of the plastic film rear wall (8). A first layer (40) of a non-woven material is welded with the front side (42) facing towards the plastic film front wall (2) to the rear side (36) of the plastic film interlayer (22). Said non-woven layer (40) projects in portions beyond the opening-facing edge (28) of the plastic film interlayer (22) in the direction of the bag opening (30), wherein the remaining larger portion is located below the opening-facing edge (28). In the embodiment shown, the opening-facing edge (28) of the plastic film interlayer (22) is connected neither to the plastic film front wall (2) nor to the plastic film rear wall (8). Instead, there is only a connection along the bottom-facing edge (34) to the plastic film rear wall (8) and a connection of the first lateral edge (4, 10) to the plastic film front wall (2) and the plastic film rear wall (8) in the region of the first lateral boundary (70) and a connection of the second lateral edge (6, 12) to the plastic film front wall (2) and the plastic film rear wall (8) in the region of the second lateral boundary (72). Accordingly, in this embodiment too, the first lateral edge (4) of the plastic film front wall (2) and the first lateral edge (10) of the plastic film rear wall (8) are welded together to form a first lateral boundary, and the second lateral edge (6) of the plastic film front wall (2) and the second lateral edge (12) of the plastic film rear wall (8) are welded together to form a second lateral boundary. In the embodiment shown, the plastic film bag according to the present disclosure does not additionally have plastic film side walls. FIG. 7 shows a schematic cross-sectional view of the embodiment according to FIG. 4.

Figure 8:
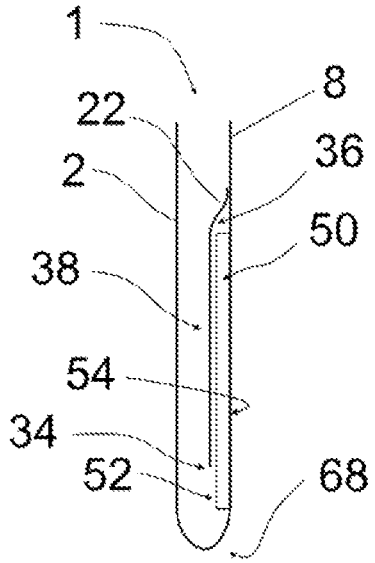

FIG. 8 shows a schematic cross-sectional view of a third embodiment of the first variant of the plastic film bag (1) according to the present disclosure. A second layer (50) in the form of a non-woven layer is used therein. The latter, unlike the first layer of the embodiment according to FIG. 1, is welded via its rear side (54) to the plastic film rear wall (8) and projects in portions beyond the bottom-facing edge (34) of the plastic film interlayer (22) in the direction of the plastic film bag bottom (68).

The features of the present disclosure disclosed in the above description, in the claims and in the drawings may be of significance for implementation of the present disclosure in its various embodiments either individually or in any desired combination.

The various embodiments described above can be combined to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plastic film bag with a bag opening and an opposite bag end, comprising:

a plastic film front wall with a bag opening edge and a first lateral edge and an opposite second lateral edge, a plastic film rear wall with a bag opening edge and with a first lateral edge and an opposite second lateral edge, a plastic film bag bottom, a plastic film interlayer arranged between the plastic film front wall and the plastic film rear wall with a first lateral edge and an opposite second lateral edge, a bottom-facing edge and an opposite opening-facing edge, and a rear side facing towards the plastic film rear wall and a front side facing towards the plastic film front wall, wherein, along the opening-facing edge or at a distance from the opening-facing edge, said plastic film interlayer is connected to the plastic film rear wall from or at a distance from the first lateral edge of the plastic film rear wall in the direction of or up to the opposite second lateral edge of the plastic film rear wall, wherein the bottom-facing edge is located at the plastic film bag bottom or at a distance from the plastic film bag bottom and wherein the opening-facing edge is located at or at a distance from the bag opening edge of the plastic film rear wall, said plastic film bag further comprising:

a first layer comprising a liquid-absorbent material with a front side facing towards the plastic film front wall and a rear side facing towards the plastic film rear wall, wherein the first layer is directly or indirectly connected via the front side to the rear side of the plastic film interlayer, and wherein i) the first layer extends in the direction of the bottom-facing edge of the plastic film interlayer and ends at a distance from said bottom-facing edge of the plastic film interlayer, or ii) wherein the first layer extends up to the bottom-facing edge of the plastic film interlayer, or iii) wherein the first layer projects in parts beyond the bottom-facing edge of the plastic film interlayer in the direction of or up to the plastic film bag bottom, and/or a second layer comprising a liquid-absorbent material with a front side facing towards the plastic film front wall and a rear side facing towards the plastic film rear wall, wherein the second layer is directly or indirectly connected via the rear side to the plastic film rear wall, and wherein i) the second layer extends in the direction of the bottom-facing edge of the plastic film interlayer and ends at a distance from said bottom-facing edge of the plastic film interlayer, or ii) wherein the second layer extends up to the bottom-facing edge of the plastic film interlayer, or iii) wherein the second layer projects in parts beyond the bottom-facing edge of the plastic film interlayer in the direction of or up to the plastic film bag bottom, wherein the bottom-facing edge of the plastic film interlayer is not connected to the plastic film front wall and to the plastic film rear wall, wherein, apart from the connection along the opening-facing edge or at a distance from the opening-facing edge to the plastic film rear wall and the connection of the first lateral edge to the plastic film front wall and the plastic film rear wall in the region of a first lateral boundary and the connection of the second lateral edge to the plastic film front wall and the plastic film rear wall in the region of a second lateral boundary, the plastic film interlayer is not connected to the plastic film front wall and the plastic film rear wall, wherein the first lateral edge of the plastic film front wall and the first lateral edge of the plastic film rear wall are connected together to form a first lateral boundary, and the second lateral edge of the plastic film front wall and the second lateral edge of the plastic film rear wall are connected together to form a second lateral boundary, and wherein the connection of the plastic film interlayer to the plastic film rear wall extends from or at a distance from the first lateral boundary in the direction of or up to the second lateral boundary.

2. The plastic film bag according to claim 1, wherein the plastic film bag bottom is located at a transition from the plastic film front wall to the plastic film rear wall.

3. The plastic film bag according to claim 1, wherein the liquid-absorbent material of the first layer or the second layer is or comprises a non-woven material.

4. The plastic film bag according to claim 1, further comprising a further plastic film layer connected to the front side of the first layer via which further plastic film layer the first layer is connected to the rear side of the plastic film interlayer, or a further plastic film layer connected to the rear side of the second layer via which further plastic film layer the second layer is connected to the plastic film rear wall.

5. The plastic film bag according to claim 1, wherein the first lateral edge of the plastic film interlayer is connected to the plastic film front wall and the plastic film rear wall in a region of the first lateral boundary and/or wherein the second lateral edge of the plastic film interlayer is connected to the plastic film front wall and the plastic film rear wall in a region of the second lateral boundary.

6. The plastic film bag according to claim 1, wherein the plastic film front wall, the plastic film rear wall and the plastic film bag bottom are formed in one piece.

7. The plastic film bag according to claim 1, wherein the plastic film front wall, the plastic film rear wall and the plastic film interlayer comprise polyester or polyolefins.

8. The plastic film bag according to claim 1, further comprising a bag closure in the region of the bag opening.

9. The plastic film bag according to claim 1, further comprising a first plastic film side wall and/or a second plastic film side wall.

10. The plastic film bag according to claim 1, wherein the plastic film bag is a shipping bag.

11. The plastic film bag according to claim 1, wherein the plastic film interlayer is welded to the plastic film rear wall from or at a distance from the first lateral edge of the plastic film rear wall in the direction of or up to the opposite second lateral edge of the plastic film rear wall.

12. The plastic film bag according to claim 1, wherein the opening-facing edge is located at a distance from the bag opening edge of the plastic film rear wall.

13. The plastic film bag according to claim 1, wherein:

the first layer is directly or indirectly welded via the front side to the rear side of the plastic film interlayer, and/or the second layer is directly or indirectly welded via the rear side to the plastic film rear wall.

14. The plastic film bag according to claim 1, wherein:

the first lateral edge of the plastic film front wall and the first lateral edge of the plastic film rear wall are welded together to form the first lateral boundary, and/or the second lateral edge of the plastic film front wall and the second lateral edge of the plastic film rear wall are welded together to form the second lateral boundary.

15. The plastic film bag according to claim 2, wherein the plastic film bag bottom comprises a fold, pleat or weld seam.

16. The plastic film bag according to claim 1, wherein the connection of the plastic film interlayer to the plastic film rear wall extends from the first lateral boundary up to the second lateral boundary.

17. The plastic film bag according to claim 7, wherein the plastic film front wall, the plastic film rear wall and the plastic film interlayer comprise polyethylene terephthalate or polyethylene.

18. The plastic film bag according to claim 8, wherein the bag closure is reclosable.

19. The plastic film bag according to claim 10, wherein the shipping bag is configured to carry liquid samples.

* * * * *